US006662613B2

(12) United States Patent
Ichiryu et al.

(10) Patent No.: US 6,662,613 B2
(45) Date of Patent: Dec. 16, 2003

(54) LONG MEMBER BENDING APPARATUS

(75) Inventors: Ken Ichiryu, Kanagawa (JP); Yuji Terauchi, Tochigi (JP); Katsuhiro Fujita, Tochigi (JP)

(73) Assignee: Kikuchi Seisakusho Co., Ltd., Tokyo (JP)

( * ) Notice: Subject to any disclaimer, the term of this patent is extended or adjusted under 35 U.S.C. 154(b) by 7 days.

(21) Appl. No.: 10/150,452

(22) Filed: May 17, 2002

(65) Prior Publication Data

US 2002/0170329 A1 Nov. 21, 2002

(30) Foreign Application Priority Data

May 18, 2001 (JP) ..... 2001-187310

(51) Int. Cl.[7] ..... B21D 5/14
(52) U.S. Cl. ..... 72/173; 72/166; 72/174
(58) Field of Search ..... 72/166, 173, 174, 72/170, 284, 285, 307, 467

(56) References Cited

U.S. PATENT DOCUMENTS 4,062,216 A * 12/1977 Hanamoto et al. ..... 72/128
5,706,691 A * 1/1998 Okamoto et al. ..... 72/237
5,862,698 A * 1/1999 Yogo ..... 72/173
5,884,517 A * 3/1999 Yogo ..... 72/16

FOREIGN PATENT DOCUMENTS

JP 59-150619 * 8/1984 ..... 72/166
JP 63-104726 * 5/1988 ..... 72/166

* cited by examiner

*Primary Examiner*—Ed Tolan
(74) *Attorney, Agent, or Firm*—Heslin Rothenberg Farley & Mesiti P.C.

(57) ABSTRACT

In a long member bending apparatus having a bending head and a material supply unit, the bending head is composed of a base plate having a guide pipe, which includes a guide hole for passing a long member, at the center thereof, a movable plate having a die, which applies a bending force to the long member supplied from the guide pipe forward, disposed at the center thereof, and six extendable units including hydraulic cylinders interposed between the base plate and the movable plate and universal joints disposed to both the ends of each hydraulic cylinder, thereby a parallel link mechanism is arranged that executes a motion of a total of six degrees of freedom including three degrees of freedom of translational movement and three degrees of freedom of rotation by expanding and contracting the hydraulic cylinders to set the position (distance, offset), inclination, and the like of the movable plate with respect to the base plate. With this arrangement, there can be provided a long member bending apparatus having a simple structure capable of bending a pipe member, a bar member, a strip member that has an asymmetric cross section, and the like.

2 Claims, 6 Drawing Sheets

LONG MEMBER BENDING APPARATUS

BACKGROUND OF THE INVENTION

1. Field of the Invention

The present invention relates to a long member bending apparatus suitable to bend a long member such as a pipe member, bar member, shape member, and the like in a curved shape.

2. Description of the Related Art

There is conventionally a braid or lace bending apparatus disclosed in Japanese Examined Patent Application Publication No. Sho58-43165 (43165/83) as a bending apparatus for being a long member in a curved shape. The braid bending apparatus is used to form bent products such a window frame structure for automobile, and the like from strip materials having various cross sections. The braid bending apparatus is composed of a positioning guide having a plurality of rollers that form a gap therebetween to pass a material therethrough, a bending guide having a plurality of rollers that form a gap therebetween to pass the material supplied from the positioning guide therethrough, an outside frame for supporting the bending guide by a universal joint mechanism so as to incline the bending guide freely, a rotary plate mechanism for rotating the outside frame about the direction in which the material is supplied from the positioning guide as an axis, an X-Y slide mechanism on which the rotary plate mechanism is mounted so that the rotary plate mechanism is moved on a plane vertical to the direction in which the material is supplied from the positioning guide, and a computer for controlling. This bending apparatus has an advantage that it can correct twist distortion produced to a material having an asymmetric lateral cross section by applying twist to the material by the rotary plate mechanism. However, the apparatus has a problem in that it has a complicated structure because the bending guide is supported by the assembly of the respective movable elements of the outside frame, the rotary plate mechanism, and the X-Y slide mechanism and that the apparatus is increased in size because the bending reaction force of the material is transmitted from the bending guide to the respective elements of the outside frame, the rotary plate mechanism and the X-Y slide mechanism in series and thus all the elements must have strength and rigidity withstanding the bending reaction force of the material.

There is also a pushing pass bending apparatus disclosed in Japanese Examined Patent Application Publication No. Hei5-12047 (12047/93) as another bending apparatus. This pushing pass bending apparatus bends a pipe member, a shape member, and a solid member, and is composed of a guide cylinder through which a material is passed, a die through which the material supplied from the guide cylinder is passed, and a means for relatively offsetting the central axis of the guide cylinder from the central axis of the die. Further, Japanese Examined Patent Application Publication No. Hei7-110382 (110382/95) discloses an apparatus improving the pushing pass bending apparatus disclosed in Japanese Examined Patent Application Publication No. Hei5-12047 (12047/93). This improved type pushing pass bending apparatus is provided with an inclining mechanism for optionally or freely inclining the central axis of a die in a direction in which a material is bent and advanced by forming the outer peripheral side of the die in a spherical shape and disposing a bearing for receiving the spherical portion of the die, in addition to a mechanism for relatively offsetting the central axis of a guide cylinder from the central axis of a shape hole as in the conventional apparatus. The inclining mechanism makes it possible to bend a material with a bending radius smaller than a conventional one with sufficient accuracy. However, the pushing pass bending apparatus and the improved pushing pass bending apparatus have a problem in that they cannot twist a material and thus cannot bend a strip material while twisting it because the apparatuses do not rotate the die with respect to the central axis thereof.

As described above, the bending apparatus disclosed in Japanese Examined Patent Application Publication No. Sho58-43165 (43165/83) has the advantage that the twist distortion of a material having an asymmetric lateral cross section can be corrected by the rotary plate mechanism. However, the apparatus has a problem in that it has the complicated structure because the bending guide is composed of the series assembly of the respective movable elements of the outside frame, the rotary plate mechanism, and the X-Y slide mechanism and that the apparatus is increased in size because the bending reaction force of a material is transmitted from the bending guide to the respective elements of the outside frame, the rotary plate mechanism, and the X-Y slide mechanism in series and thus the respective elements must have strength and rigidity withstanding the bending reaction force of the material. Further, the respective pushing pass bending apparatuses disclosed in Japanese Examined Patent Application Publications Nos. Hei5-12047 (12047/93) and Hei7-110382 (110382/95) have a problem in that they cannot apply twist to a material because the die does not rotate with respect to the central axis thereof.

SUMMARY OF THE INVENTION

An object of the present invention is to solve the above problems and to provide an improved long member bending apparatus having a simple structure and high rigidity and capable of bending not only a pipe member, a bar member, and the like having a symmetrical lateral cross section but also a strip member that must be twisted.

To achieve the above mentioned object, a long member bending apparatus of the present invention includes a bending head for bending a long member in a curved shape; a material supply unit for supplying a long member to the bending head, and a control system for controlling the bending head and the material supply unit, wherein the bending head comprises a base plate having a guide pipe, through which a guide hole for passing the long member supplied from the material supplied therethrough is formed, standing upright at the center of a base plate; a movable plate having a die, which applies a bending force to the long member supplied from the guide pipe forward while passing it therethrough, disposed at the center thereof; and six extendable units comprising hydraulic cylinders interposed between the base plate and the movable plate and universal joints disposed to both the ends of each hydraulic cylinder, wherein the six extendable units join the universal joints to the peripheral edge portions of both the base plate and the movable plate so as to be formed in an approximate truss state and construct a parallel link mechanism for causing the movable plate to execute a motion having three degrees of freedom of translational movement and three degrees of rotation with respect to xyz coordinates set on the base plate by expanding and contracting the hydraulic cylinders. The control system adjusts the lengths of the respective hydraulic cylinders by setting the position and inclination of the movable plate with respect to the base plate and the twist angle of the movable plate about the central axis thereof.

When the long member is bent by the long member bending apparatus arranged as described above, the long member is inserted into the die of the movable plate from the guide hole of the base plate until the tip end of the long member reaches the die, and the bending parameters comprising the offset (a) of the central point of the die with respect to the axial center of the guide hole, the distance (b) from the tip end of the guide pipe to the central point of the die along the axial center of the guide hole, the inclining angle ($\alpha$) of the plane including lateral cross section of the die with respect to the plane including lateral cross section of the guide hole, and the twist angle ($\theta$) of the movable plate about the axial center of the die are set by the control system according to a desired bending radius ($\rho$) of the long member. The material supply unit pushes the long member to the bending head in a state that the control system sets the bending head by expanding and contracting the six extendable units according to these bending parameters. Thus, the long member is bent to the bending radius ($\rho$) between the guide hole and the die in such a manner that the outer peripheral surface thereof is restricted at the two positions of the guide hole and the die as well as the long member is processed to the twist angle ($\theta$) by the die.

The bending head has a simple structure because it is composed of the base plate, the movable plate, and the six extendable units connecting both the plates as well as the movable plate is restrict with high rigidity because it is supported by the six extendable units fixed to the peripheral edge portion thereof. According to the bending head, a long member such as a pipe, bar, and the like having a symmetrical cross section can be bent by setting the three parameters of the offset (a) of the central point of the die with respect to the axial center of the guide hole, the distance (b) from the tip end of the guide pipe to the axial center of the guide hole, and the inclining angle ($\alpha$) of the die with respect to a plane perpendicular to the axial center of the guide hole. Further, a strip member that must be twisted when it is bent can be processed by further adding the parameter of the rotational angle ($\theta$) of the movable plate about the axial center of the shape hole, in addition to the above three parameters.

DESCRIPTION OF THE PREFERRED EMBODIMENTS

Figure 1:
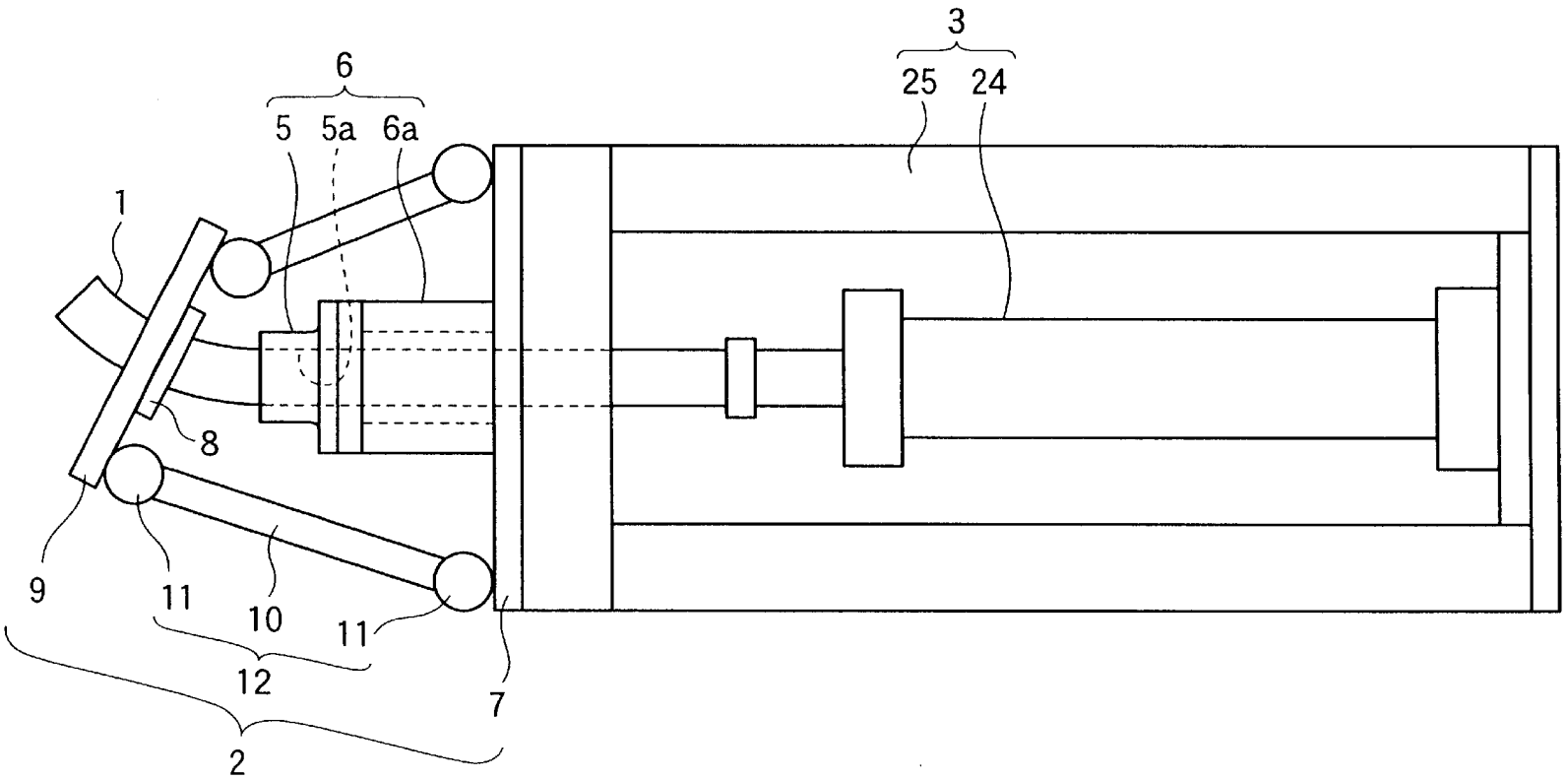
FIG. 1 is a view showing the overall arrangement of a long member bending apparatus as an embodiment of the present invention.
Figure 5:
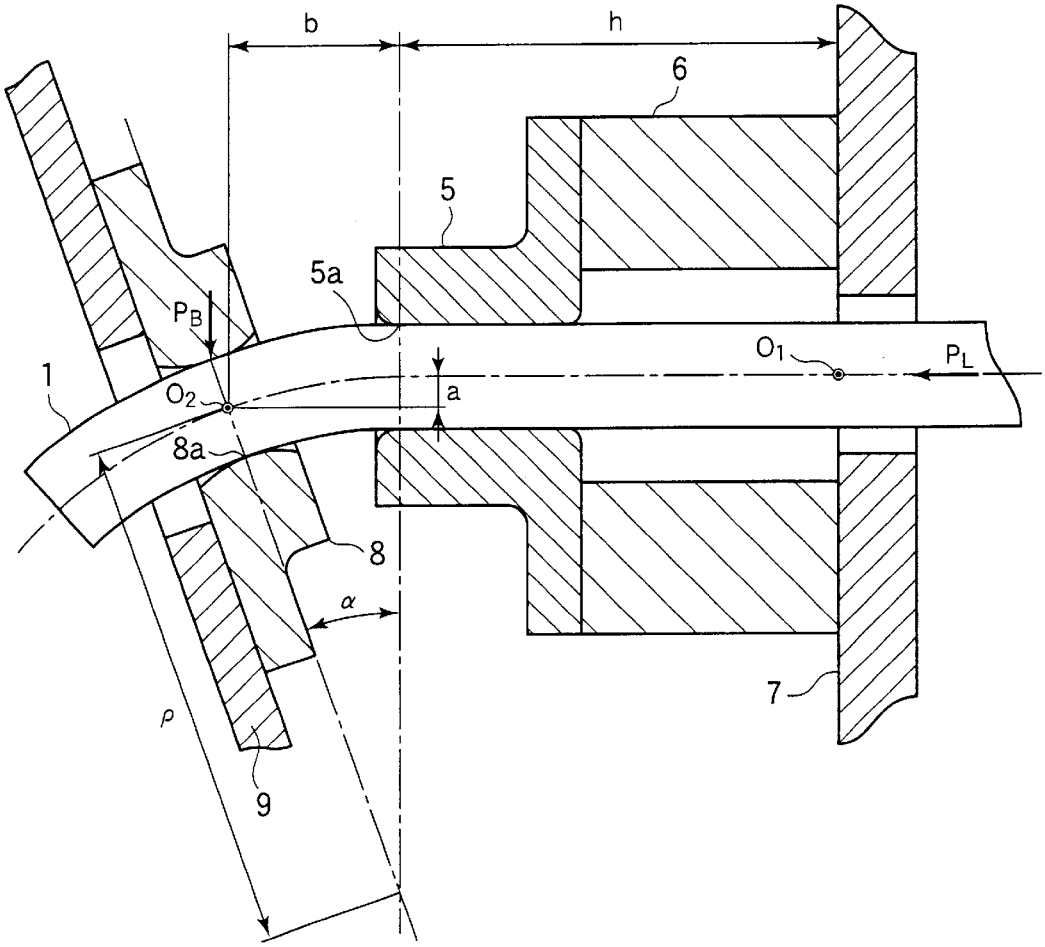
FIG. 5 is a view explaining bending parameters of a long member.
Figure 6:
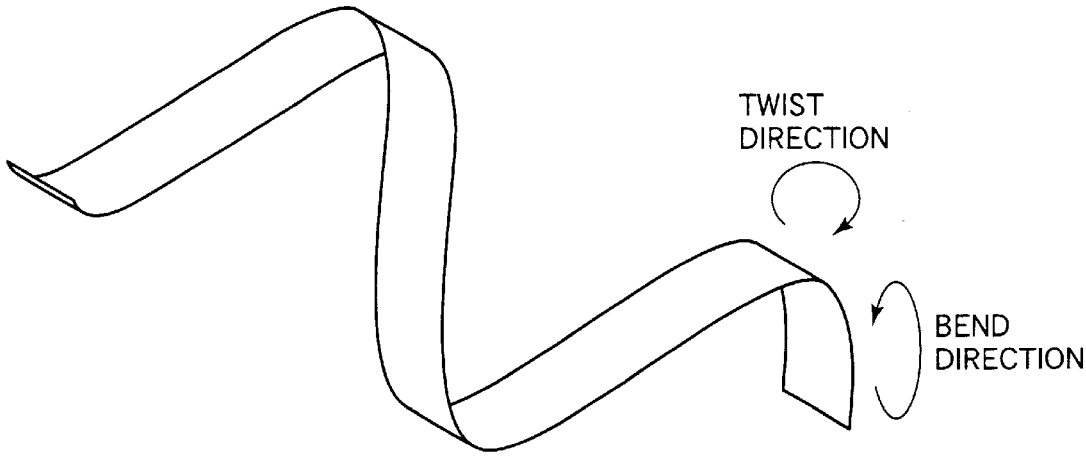
FIG. 6 is a view showing a strip member subjected to twist bending.

An embodiment of the present invention will be described below with reference to the drawings. FIG. 1 is a view showing the overall arrangement of a long member bending apparatus (hereinafter, simply referred to as "bending apparatus") as an embodiment of the present invention, FIG. 2 is a view showing the arrangement of a bending head, FIG. 3 is a view explaining a layout of expandable units constituting the bending head in a six-axis parallel link motion base, FIG. 4 is a view explaining operation of a six-axis parallel link mechanism, FIG. 5 is a view explaining bending parameters of a long member, and FIG. 6 is a view showing a strip member subjected to twist bending.

As shown in FIG. 1, the bending apparatus of the embodiment of the present invention is generally composed of a bending head 2, a material supply unit 3 for supplying a long member to the bending head 2, and control system (not shown) for controlling the bending head 2 and the material supply unit 3.

Figure 2:
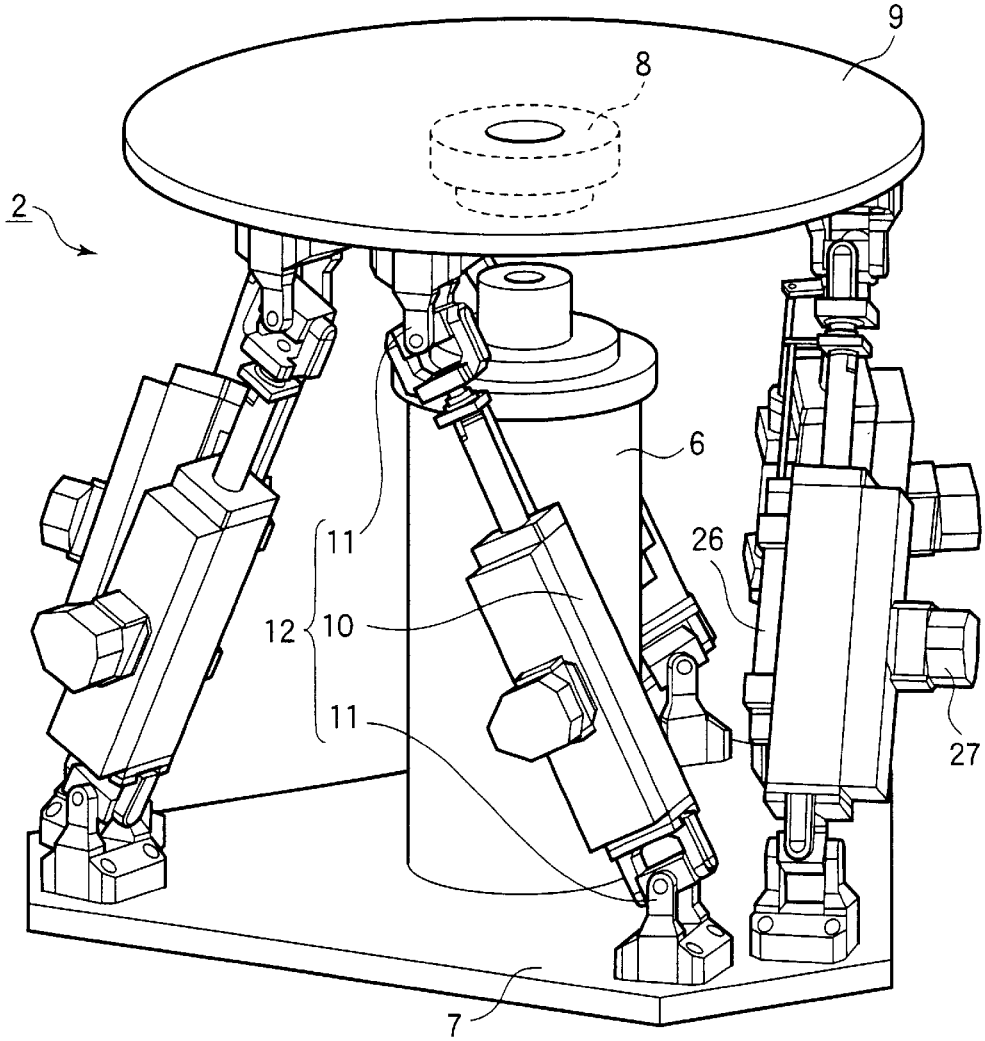
FIG. 2 is a view showing the arrangement of a bending head.

As shown in FIGS. 1 and 2, the bending head 2 is composed of a base plate 7 that has a guide pipe 6 standing at the center thereof upright, the guide pipe 6 including a guide plate 5 that is composed of a guide hole 5*a* through which a long member 1 is passed and a support pipe 6*a* having the guide plate 5 attached to the front end thereof, a movable plate 9 disposed in front of the throttle device 6 and having a die 8 disposed at the center thereof for applying a bending force to the long member 1 supplied from the guide pipe 6, and six extendable units 12 disposed between the base plate 7 and the movable plate 9. Each of the extendable units 12 is composed of a hydraulic cylinder 10 and universal joints 11 disposed at both the end thereof. The universal joint 11 at an end of each hydraulic cylinder 10 is attached to the peripheral edge portion of the front surface of the base plate 7 and the universal joints 11 at the other end thereof is attached to the peripheral edge portion of the rear surface of the movable plate 9. It is preferable to set the outside size of the movable plate 9 smaller than the base plate 7 to prevent the long member 1 from interfering the movable plate 9 when it is bent. The bending head 2 is arranged as the six-axis parallel link mechanism that causes the movable plate 9 to execute a motion of a total of six degrees of freedom including three degrees of freedom of translational movement and three degrees of freedom of rotation with respect to the base plate 7 when the expandable units 12 expand and contract. The bending head 2 is arranged by disposing the guide pipe 6 and the die 8 to the six-axis parallel link mechanism. A six-axis parallel link motion base made by Tokyo Precision Instruments Co., Ltd. is used as the six-axis parallel link mechanism. Note that the six-axis parallel link motion base is a trade name of Tokyo Precision Instruments Co., Ltd. A potentiometer 26 for detecting a cylinder length and a servo valve 27 for controlling an operating fluid are mounted on each hydraulic cylinder 10.

Figure 3:
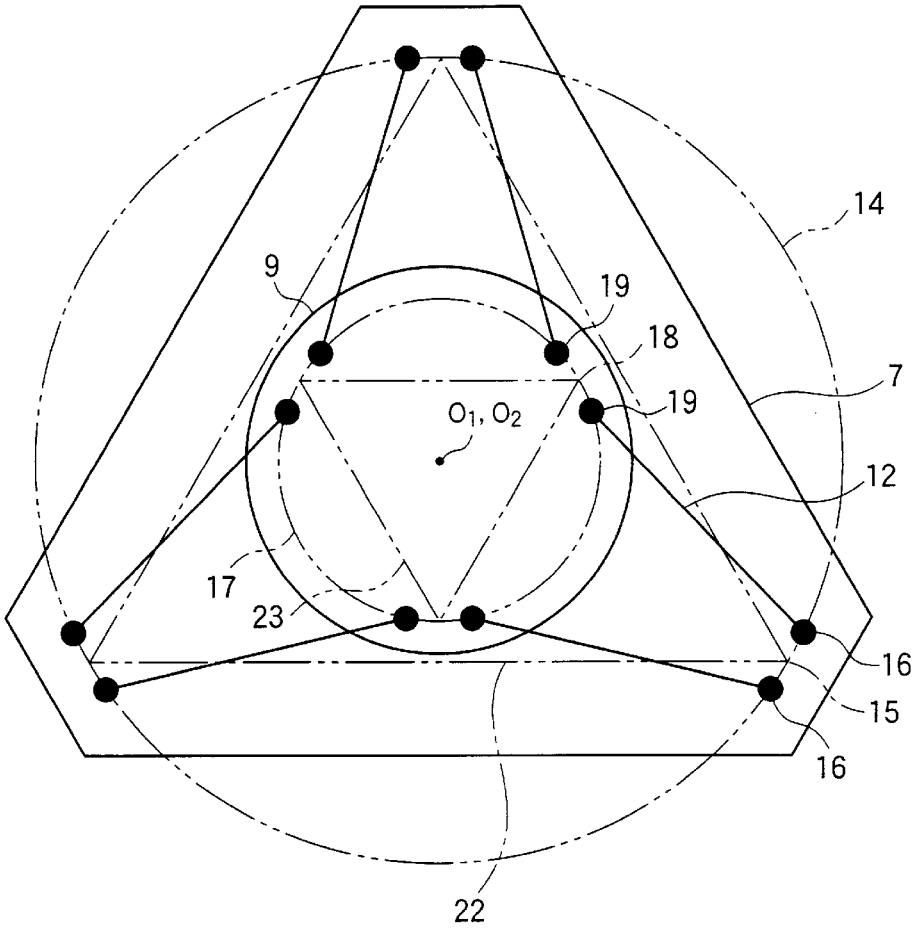
FIG. 3 is a view showing a layout of expandable units constituting the bending head in a six-axis parallel link motion base.

FIG. 3 is a plan view explaining the positional relationship among the base plate 7, the movable plate 9, and the six extendable units 12 in the six-axis parallel link motion base. FIG. 3 shows a state in which the six extendable units 12 are set to the same length. Accordingly, the base plate 7 is in parallel with the movable plate 9 with respect to the planes thereof, and the central axes of the respective plates are located on the same axis. When points 15 are located at the positions where the circumference of a virtual circle 14 formed about the central point of the base plate 7 on the same plane as the front surface of the base plate 7 as a center is divided into three equal sections, the positions where the universal joints 11 are attached to the base plate 7 side are located at respective two points 16 and 16 that are located on the circumference across each point 15 and have an equal distance to each point 15. Whereas, when points 18 are located at the positions where the circumference of a virtual circle 17 formed about the central point of the movable plate 9 on the same plane as the front surface of the movable plate 9 as a center is divided into three equal sections, the positions 19 and 19 where the universal joints 11 are attached to the movable plate 9 side are located at respective two points 19 and 19 that are located on the circumference across each point 18 and have an equal distance to each point 18. Then, the six extendable units 12 are installed approximately in a truss state bridging between each six pairs of the installing positions 16 and 19 that are located in the nearest distances between the base plate 7 and the movable plate 9 in the state that a triangle 22 connecting the three equally divided points of the base plate 7 is offset each other from a triangle 23 connecting the three equally divided points of the movable plate 9 by a rotational angle of 180°.

Figure 4A:
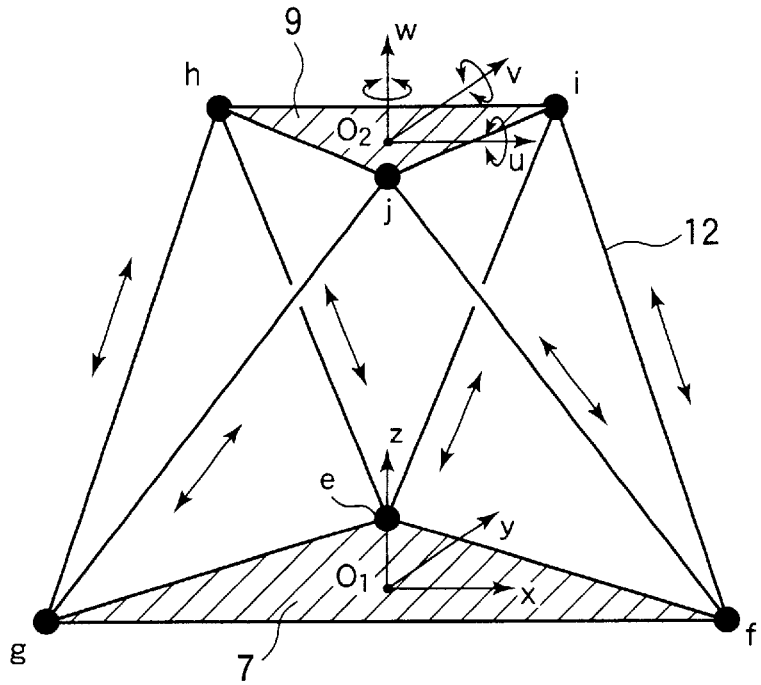
FIGS. 4*a* and 4*b* are views explaining operation of a six-axis parallel link mechanism.
Figure 4B:
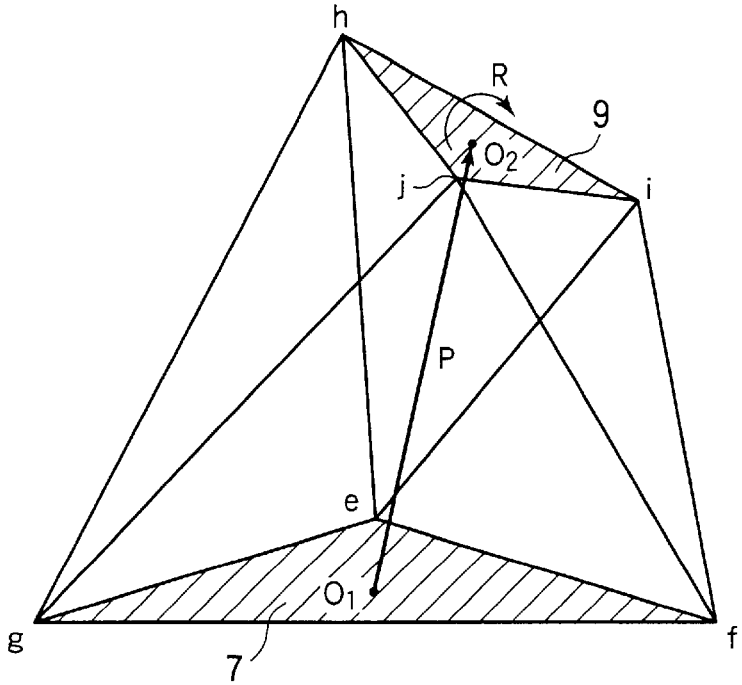

Operation of the six-axis parallel link motion base can be explained in approximation to the model of a six-axis parallel link mechanism shown in FIG. 4A. The model has a truss structure arranged in the six-axis parallel link motion base shown in FIG. 3 such that the six extendable units 12 are joined between the base plate 7 and the movable plate 9 through pins by gathering the positions 16 and 16 of the respective two adjacent universal joints to one position. In the model of the six-axis parallel link mechanism, an xyz rectangular coordinates are set on the front surface of the base plate 7 using the central point $O_1$ of the guide hole 5*a* as an origin, and a z-axis is used as the central axis of the guide hole 5*a*. Further, uvw rectangular coordinates are set using the central point $O_2$ of the die 8 mounted on the movable plate 9 as an origin, a w-axis is used as the central axis of the die 8, and a uv plane is made flush with the plane of the shape hole 8*a* of the die 8 (refer to FIG. 5). The central point of the movable plate 9, in other words, the central point $O_2$ of the die makes a translational movement in the three directions of the x-, y- and z-axes set on the base plate 7 and rotates about the respective u-, v- and w-axes set to the movable plate 9. With this operation, the movable plate 9 makes a motion of the total of six degrees of freedom of the three degrees of freedom of transnational movement and the three degrees of freedom of rotation with respect to the base plate 7. FIG. 4B shows a state in which the movable plate 9 is moved with respect to the base plate 7, wherein the position of the origin $O_2$ of the movable plate 9 is represented by a position vector P as to the origin $O_1$ of the base plate 7, and the attitude of the movable plate 9 is represented by the matrix R of the rotational angle about the respective axes u, v, and w. When the six-axis parallel link mechanism is manipulated, inverse kinematics for determining the lengths of the respective extendable units 12 from the position vector P and the matrix R of the rotational angle.

Next, parameters for bending the long member 1 will be described with reference to FIG. 5. The long member 1 is, for example, a round bar. In the bending head 2, the offset a from the axial center of the guide pipe 6 to the central point of the die 8 (hereinafter, referred to as "offset a"), the distance from the front surface of the guide hole 5*a* to the central point of the die 8 b (inter-shape distance b) and the inclining angle $\alpha$ of the die 8 to a plane perpendicular to the axial center of the guide pipe 6 are set as the parameters. Note that the die 8 has a shape hole 8*a* formed of the ridge lines of an inner wall that projects in the center direction of the pipe 8 and has triangular cross sections. The vertex of the triangular cross section that contacts with the long member is rounded as shown in FIG. 5. The guide hole 5*a* and the shape hole 8*a* are formed in sizes obtained by adding clearances to the outside size of the cross section of the long member 1. When the bending radius of the round bar is represented by $\rho$, $a=\rho(1-\cos\alpha)$ and $b=\rho\sin\alpha$ are established. When the value of one of the three parameters a, b, and $\alpha$ is determined, the value of the other two parameters are determined. Thus, the offset a, for example, is selected from the size, material (Al, Cu, steel, etc.), and the like of the round bar. In practical use, this parameter is determined according to a result of bending test performed using various materials.

The parameters a, b, and $\alpha$ are related to the xyz coordinates (origin $O_1$) on the base plate 7 and the uvw coordinates (origin $O_2$) on the movable plate 9 each shown in FIG. 4A. To make the explanation simple, it is assumed that the sheet of FIG. 4A includes both the y- and z-axes and both the v- and w-axes. The offset a can be represented by a value y on the xyz coordinates, the inter-shape distance b can be represented by a value obtained by subtracting the height h of the guide pipe 6 from a value z on the xyz coordinates, and the inclining angle $\alpha$ can be represented by a rotational angle about the x-axis as to the origin $O_2$ on the movable plate 9. Note that the height h of the guide pipe 6 is the height from the front surface of the base plate 7. Here, $P_B$ shows a force necessary to bend the long member 1 in a curved shape, and $P_L$ shows a force for pushing the long member 1 in longitudinal direction thereof. Note that when the height h of the guide pipe 6 is greatly changed in correspondence to the size or the bending radius $\rho$ of the long member 1, it is preferable to employ a structure for inserting a spacer, a shim, or the like between the guide pipe 6 and the base plate 7. This is because that the ranges in which the movable plate 9 is inclined and rotated are maximized in a certain value z and the ranges of motion is restricted as a value z gets away from the certain value z.

As shown in FIG. 1, the material supply unit 3 is composed of a frame member 26 fixed to the rear portion of the bending head 2 and a hydraulic cylinder 25 disposed to the frame member 26. The rear end of the long member 1 is pushed by the hydraulic cylinder 25 at a constant speed, thereby the long member 1 is fed through the guide hole 5*a* of the bending head 2. A dent or a clamp is formed at the tip end of the hydraulic cylinder 25 to fix the terminal end of the long member 1. It is preferable to dispose a guide roller between the hydraulic cylinder 25 and the guide pipe 6 to prevent buckling, when necessary.

The control system is composed of a personal computer. The personal computer calculates the lengths of the respective extendable units 12 from the input values of the bending parameters (a, b, $\alpha$, and $\theta$), actuates the hydraulic cylinders 10 through the servo valve 27, controls the position and attitude of the movable plate 9 of the bending head 2, and also controls the feed speed of the long member 1 fed by the hydraulic cylinder 25 of the material supply unit. The bending parameters (a, b, $\alpha$, and $\theta$) are previously determined by an experiment and stored because they are different according to the shape, size, material, and the like of the long member 1.

The long member bent by the bending apparatus of the present invention includes a strip member, in addition to a pipe member, a bar member, and a shape member having round, oval, and square cross sections. As shown in FIG. 6, the strip member can be bent in a spiral shape by bending it in a sheet thickness direction with a certain radius as well as by applying twist thereto. Further, when a strip member that has a lateral cross section formed in a curved or angle shape and is asymmetrical right and left is bent, twist distortion caused by bending can be corrected by applying twist to the strip member. An automobile window frame, for example, is exemplified as a bent product made of an asymmetrical strip member.

According to the present invention, since the long member bending apparatus comprises the base plate including the bending head and the guide pipe, the movable plate having the die, and the six extendable units connecting both the plates, the apparatus can be arranged as an apparatus having a simple structure and high rigidity, can bend a pipe member, a bar member, and the like with sufficient accuracy. Further, since the movable plate is arranged so as to rotate about the axial center of the die, the bending apparatus has an effect that it can be applied to a strip member that must be twisted when it is bent.

What is claimed is:

1. A long member bending apparatus comprising:

a bending head for bending a long member in a curved shape;

a material supply unit for supplying the long member to the bending head; and a control system for controlling the bending head and the material supply unit, wherein the bending head comprises:

a base plate having a guide pipe, through which a guide hole for passing the long member supplied from the material supply unit therethrough is formed, standing upright at the center thereof;

a movable plate having a die, which applies a bending force to the long member supplied from the guide pipe forward while passing it therethrough, disposed at the center thereof; and six extendable units including hydraulic cylinders interposed between the base plate and the movable plate and universal joints disposed to both the ends of each hydraulic cylinder, wherein the six extendable units join the universal joints to the peripheral edge portions of the base plate and the movable plate so as to be formed in an approximate truss state and construct a parallel link mechanism for causing the movable plate to execute a motion having three degrees of freedom of translational movement and three degrees freedom of rotation with respect to xyz coordinates set on the base plate by expanding and contracting the hydraulic cylinders.

2. A long member bending apparatus according to claim 1, wherein the control system adjusts the lengths of the respective hydraulic cylinders by setting the position and inclination of the movable plate with respect to the base plate and the twist angle of the movable plate about the central axis thereof.

* * * * *